US005826710A

United States Patent [19]

Kurek et al.

[11] Patent Number: 5,826,710

[45] **Date of Patent: *Oct. 27, 1998**

[54] ROCKER-TYPE ELECTRICAL SWITCH

[75] Inventors: Stephen R. Kurek, Rego Park, N.Y.; David Schroeder, El Paso, Tex.

[73] Assignee: Leviton Manufacturing Co., Inc., Little Neck, N.Y.

[ * ] Notice: The term of this patent shall not extend beyond the expiration date of Pat. Nos. 5,382,768 and 5,630,502.

[21] Appl. No.: 784,509

[22] Filed: Jan. 17, 1997

Related U.S. Application Data

[63] Continuation of Ser. No. 604,595, Feb. 21, 1996, Pat. No. 5,630,502, which is a continuation of Ser. No. 521,696, Aug. 31, 1995, Pat. No. 5,595,289, which is a continuation of Ser. No. 373,687, Jan. 17, 1995, Pat. No. 5,500,498, which is a continuation of Ser. No. 976,073, Nov. 13, 1992, Pat. No. 5,382,768.

[51] Int. Cl.[6] ..... H01H 21/82

[52] U.S. Cl. ..... 200/559; 200/557; 200/553

[58] Field of Search ..... 200/557, 553, 200/554, 555, 556, 558, 559, 561, 562, 339, 315

[56] References Cited

U.S. PATENT DOCUMENTS

| | | | |
|---|---|---|---|
| 3,591,747 | 7/1971 | Dennison | 200/559 |
| 4,169,972 | 10/1979 | Black, III et al. | 200/339 |
| 4,883,932 | 11/1989 | Van Hout et al. | 200/339 |
| 5,285,039 | 2/1994 | Satoh | 200/339 |

*Primary Examiner*—David J. Walczak
*Attorney, Agent, or Firm*—Paul J. Sutton

[57] ABSTRACT

A rocker-type electrical switch of the kind known as a "quiet switch" includes a manually depressible rocker having two opposed contact surfaces at a small angle to each other from which rocker depends a rocker arm terminating in a rocker cam. A slider positioned intermediately of the rocker and the rocker cam is moved back and forth by side-to-side movements of the rocker arm and opens and closes one or more pairs of contacts. Rocker movement is controlled by a rocker cam leaf spring engaging the rocker cam which spring has a cammed profile traversed by the rocker cam to slow the switch, lock the rocker and provide other desirable effects. The rocker cam spring is housed in a spring chamber longer than itself, allowing the rocker cam spring to float.

3 Claims, 9 Drawing Sheets

ROCKER-TYPE ELECTRICAL SWITCH

This application is a continuation of U.S. patent application No. 08/604,595 filed Feb. 21, 1996, now U.S. Pat. No. 5,630,502, which in turn is a continuation of U.S. patent application No. 08/521,696 filed Aug. 31, 1995, now U.S. Pat. No. 5,595,289, which is a continuation of U.S. patent application No. 08/373,687 filed Jan. 17, 1995, now U.S. Pat. No. 5,500,498, which is a continuation of U.S. patent application No. 07/976,073 filed Nov. 13, 1992, now U.S. Pat. No. 5,382,768.

BACKGROUND OF THE INVENTION

The present invention relates to a rocker-type electrical switch suitable for commercial and home use.

Known is a rocker-type electrical wall switch which comprises a rocker pivotally supported in a housing at a first pivot point, a movable contact brush pivotally supported at a second pivot point in the housing, a spring compressed between a downwardly extending boss on the rocker and a lower end of the contact brush, the spring being movable under compression to inclined positions relative to the brush in response to pivotal movement of the rocker between rest positions, the movement of the spring transmitting pivotal movement of the rocker to the brush, and a pair of spaced cams carried by the rocker and extending downwardly therefrom on opposite sides of an upper end of the brush, the cams engaging, respectively, with the upper end of the brush at a point above the second pivot point, and the rocker and cams being movable into engagement with the brush under pressure exerted by the spring on the rocker.

Other known devices of some relevance to the present invention include one which discloses a safety snap switch; one which teaches a snap switch based on the engagement between a rigid oscillatable member and a resilient prestressed contact in such a manner that rebound is substantially prevented; one which teaches a number of toggle type switches having various contact structures; one which teaches a switch including a contact-carrying rocker, the movement of which is produced by a compression spring, the axis of which coincides with that of a control knob or a lever, the spring transmitting its action to the rocker through a link or stirrup engaging through its end on the one hand, the rocker, and on the other hand, the spring; one which teaches a snap-action electrical switch with contact dampening means to quiet the action of lever-operated electric switches; one which teaches an electrical toggle switch having an oscillatory mounting for the contact in the inner position and association of the mounting with a simple form of an essentially leaf-type spring; one which teaches a noiseless electric switch having a pivoted operating lever biased into two switch positions by a leaf spring which engages a cylindrical anti-friction roller position between the spring and the lever; and one which teaches a compact electrical contact and electrical switch structure having a combination of a screw terminal, a push-in wire terminal, and a make or break electrical contact terminal, with the three terminals being formed in a single compact electrical compact structure from a small piece of metal strip bent at right angles between the screw terminal and the push-in terminal.

Also known is a device which comprises a mounting strap for supporting a wiring device in a metal wall box and establishing an electrical connection between the metal mounting screw and the strap. The mounting screw is inserted through the strap and threaded into a metal box or gem box.

SUMMARY OF THE INVENTION

It is an object of the present invention to provide a rocker-type switch of the type known as a "quiet switch" or designer switch which can be used in such objects as wall safes to control lighting or other electrical equipment.

It is a further object to provide such a rocker switch which is constructed such as to lend itself easily to automated assembly.

It is a still further object to provide such a rocker-type switch with a construction wherein as many parts as possible can be injection molded in one piece from a high impact thermoplastic material.

These and other objects are attained by an electrical rocker switch which comprises a manually movable rocker cover and a rocker actuator arm which responds to movement of the rocker cover to swing in a direction to move a slider in one of two opposite directions to respectively open or close the switch. The rocker-type switch further comprises an interengageable fixed terminal assembly and movable brush assembly against which the slider moves to make contact and thereby close the switch, and away from which the slider assembly moves to open the switch. The electrical rocker switch still further comprises a rocker cover frame from which the rocker actuator arm depends to swing about either side of a plane with respect to which the rocker cover is substantially symmetrical.

The rocker-type switch of the present invention can be implemented in a number of preferred embodiments, including single-pole, single-throw; single-pole, double throw; double-pole, single-throw; and double-pole, double-throw. It further comprises a sheet metal mounting strap providing a cradle-like support for holding the switch in a wall box.

The rocker actuator arm of the rocker-type switch of the present invention comprises on its lower surface a rocker cam which interacts with a cam spring positioned at the end of the actuator arm to oppose movement thereof.

The slider of the rocker-type switch of the present invention has a midportion including a tapered slot, with the tapered slot being dimensioned so as to be a tight fit for the actuator arm whereby swinging motion of the actuator arm can be performed, preferably without loss of motion, so as to cause the slider to open and close the contacts of the switch.

The cam spring of the rocker-type switch of the present invention has a special construction to facilitate operation of the rocker switch. More specifically, the cam spring is substantially symmetric about a central apex from which two short cam portions extend downwardly respectively on each side of the apex, meeting at an obtuse angle to each other. The cam switch further comprises two longer support portions respectively attached to the ends of the short cam portions and respectively being directed upward relative to each cam portion. The spring terminates in respective turned under outer end portions in each end pocket of a spring chamber.

BRIEF DESCRIPTION OF THE DRAWINGS

FIG. 2 is a bottom plan view of a rocker cover being a component of the switch of FIGS. 1 to 1D;

FIG. 3 is a section on the line 3—3 of FIG. 2;

FIG. 4 is a staggered section on the line 4—4 of FIG. 2;

FIG. 5 is a top plan view of a rocker actuator arm, the arm being a component of the switch of FIGS. 1 to 1D;

FIG. 6 is a bottom plan view of the rocker actuator arm of FIG. 5;

FIG. 7 is a front elevational view of the rocker actuator arm of FIG. 5;

FIG. 8 is a staggered sectional view on the line 8—8 of FIG. 5;

FIG. 9 is an enlarged sectional view on the line 9—9 of FIG. 5;

FIG. 10 is a top plan view of a slider, the slider being a component of the switch of FIGS. 1 to 1D;

FIG. 11 is a front elevation of the slider shown in FIG. 10;

FIG. 12 is a left-hand side, or end elevation of the slider shown in FIG. 10;

FIG. 13 is a right-hand side, or end elevation of the slider shown in FIG. 10;

FIG. 14 is a section on the line 14—14 of FIG. 10;

FIG. 15 is a perspective view of the mounting strap shown in FIGS. 1 to 1D;

FIG. 16 is a front elevational view of a second embodiment of a rocker cam spring, being a component of the switch shown in FIGS. 1 to 1D; and FIG. 17 is a front elevational view of a third embodiment of a rocker cam spring.

DETAILED DESCRIPTION OF THE INVENTION

Figure 1:
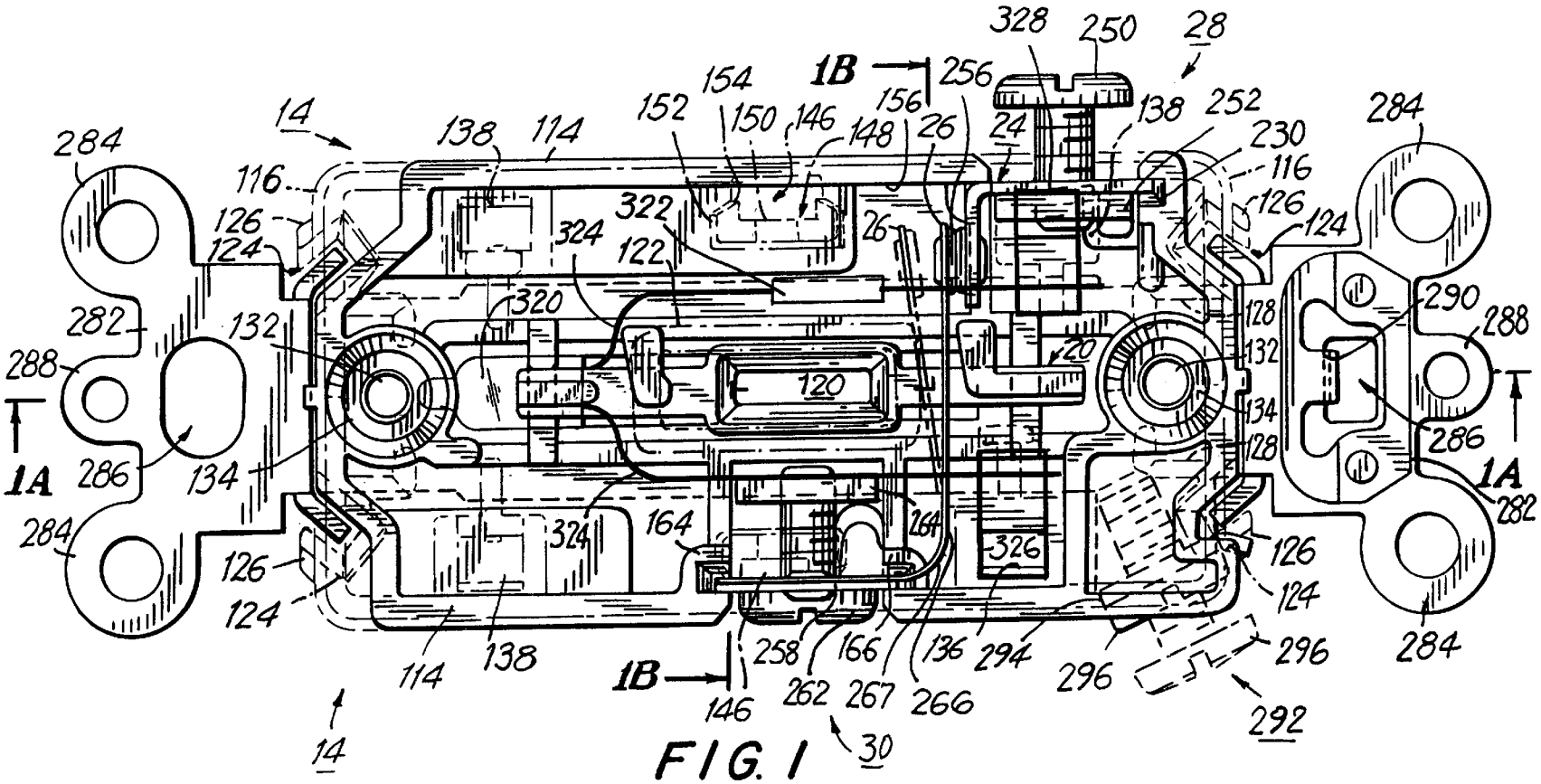
FIG. 1 is a top plan view of a single-pole, single-throw rocker-type wall-mount switch seated in a mounting strap, from which switch a rocker assembly comprising a rocker actuator arm and a rocker cover have been removed, and wherein the upper structure of the switch 54, notably a rocker cover frame, has been drawn transparently, in broken lines, to show underlying components.
Figure 1A:
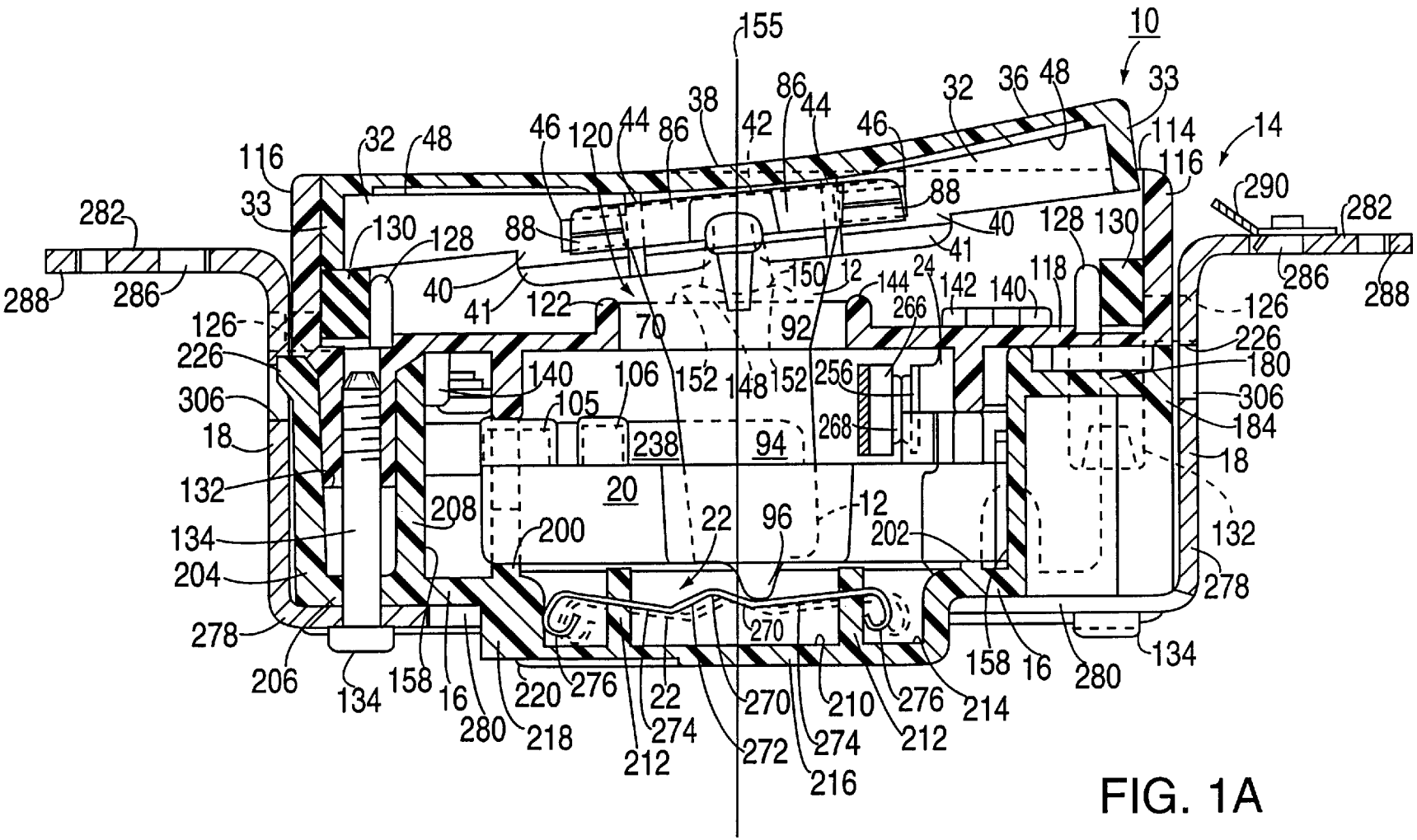
FIG. 1A is a section on the line 1A—1A of FIG. 1 with the rocker assembly in place and with some structure broken away to show details of a front wire clamp assembly, while this and another wire clamp assembly are screwed outwards as compared with their FIG. 1 positions.
Figure 1B:
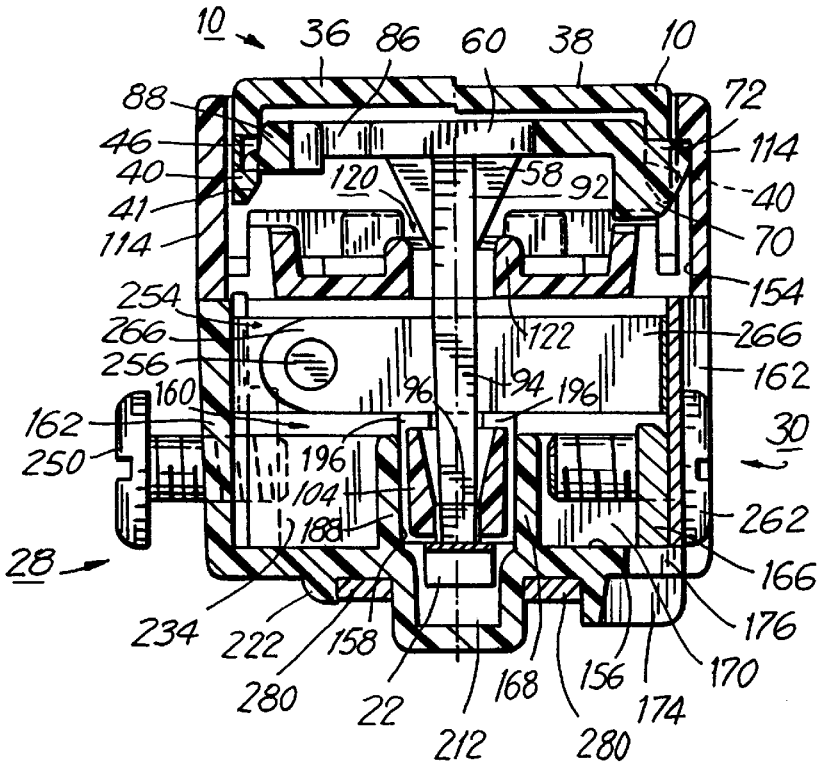
FIG. 1B is a staggered sectional view on the line 1B—1B of FIG. 1 with some parts shown in elevation rather than section, and with some parts removed, as will be explained.
Figure 1D:
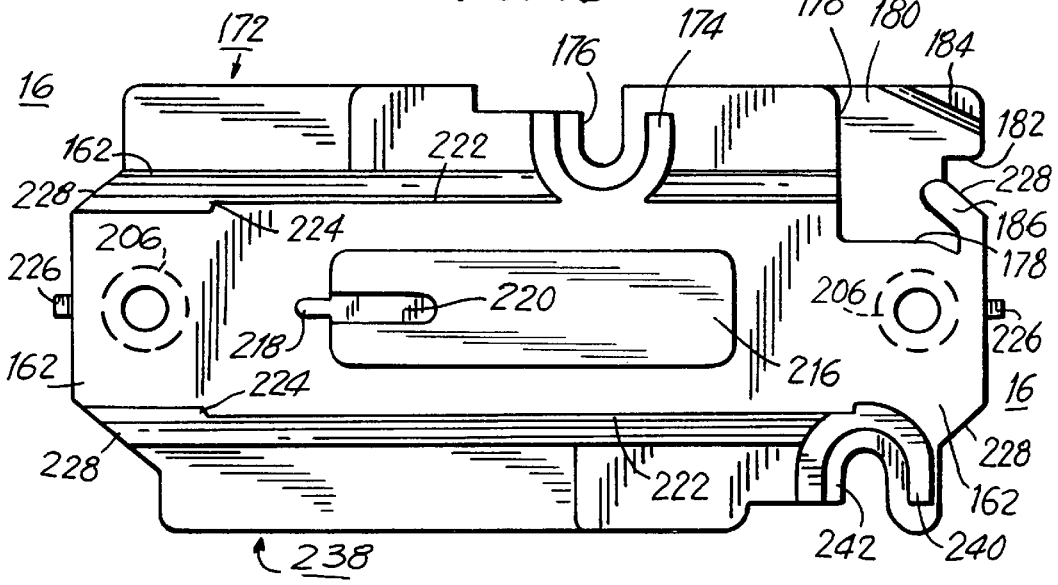
FIG. 1D is a bottom plan view of the switch base of FIGS. 1 to 1C.

Referring to FIGS. 1 to 1D of the drawings, the single-pole, single-throw rocker-type switch shown is only one preferred embodiment of the invention which can also be practiced in two-pole, three-pole, and four-pole embodiments as well as double-throw embodiments.

The rocker-type switch shown is also of the kind often known as a "quiet switch" or designer switch and is intended primarily for flush mounting in a wall box or gem box to control lighting or other electrical equipment. These switches usually have a rather large rocker, offering a contact surface of about two to three square inches, which protrudes only a small distance, perhaps a quarter of an inch or less, above its surrounding cover or frame. So-called quiet switches have a gentle action to be easily turned on or off with a simple, non-dextrous push, tap or patting action which is appealing to busy adults and helpful to the elderly or disabled. The rocker is pivotable about a transverse center axis between two or more positions according to the number of throws designed into the switch.

The switches of this invention are engineered throughout to be of a high quality, commercial grade; to be robust and durable; to meet high electrical standards of both utility and safety and to be suitable for efficient and economical mass-production.

In describing the switch shown in the drawings, directional references such as upward, underneath, right and left, front and rear, shall refer to the disposition of the switch shown in FIG. 1A where the switch is generally horizontal and its rocker has upwardly facing contact surfaces.

The major or larger components of the switch are a rocker assembly comprising a rocker cover 10 and a rocker actuator arm 12, which rocker assembly is pivotally mounted in a box-like rocker cover frame 14; a boat-shaped or tub-shaped switch base 16 that mates with the rocker cover frame 14 and receives the actuator arm 12; and a sheet metal mounting strap 18 providing a cradle-like support to hold the switch in a wall box (not shown). Electrical components, a brush-actuating slider and a motion-controlling rocker cam spring are all carried in the switch base.

With the exception of the mounting strap 18, these larger components of the switch are all rather complex structures, each of which is carefully designed to be suitable for molding in one piece, preferably by injection molding a high-impact thermoplastic material which has limited resilience in its thinner sections to provide enough give for various mating portions to snap together, and which is electrically insulative. A suitable and preferred material is a plastic such as, for example, LEXAN plastic identified as a trademark of The General Electric Company, and in particular, LEXAN 141.

The switch base 16 has a multiplicity of chambers and recesses which accommodate a brush-engaging slider 20 through which the rocker actuator arm 12 extends, a rocker cam spring 22 against which the end of the rocker actuator arm 12 rides, an interengaging fixed terminal assembly 24 and movable brush assembly 26 and respective front and rear wire clamp assemblies 30 and 28.

Depressing the rocker cover 10 at one end or the other swings the rocker actuator arm 12 which moves the slider 20 to the left or the right, engaging or releasing the movable brush assembly 26, breaking or making contact and opening or closing the switch, as desired. These movements are controlled or influenced by the rocker actuator arm 12 riding against the cam spring 22, whose profile, disposition and resilience characteristics can produce a number of useful effects relating to the loading and locking or latching of the rocker and affecting the feel and speed of the switch. These effects may be varied by selecting or designing cam springs with diverse characteristics as will be demonstrated when describing the embodiments of the invention shown in FIGS. 16 and 17 of the drawings.

Figure 2:
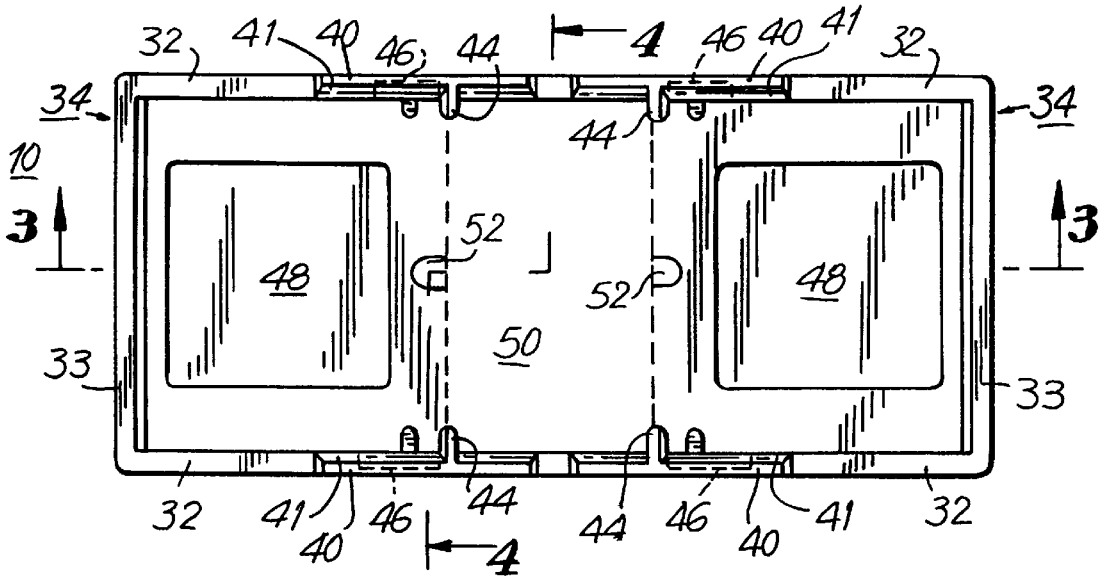
FIGS. 2 to 17 are detailed views of some of the components of the switch shown in FIGS. 1–1B. More specifically.
Figure 3:
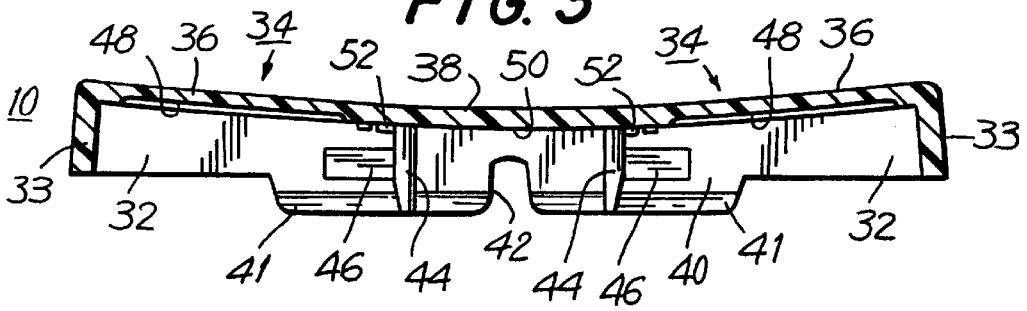
Figure 4:
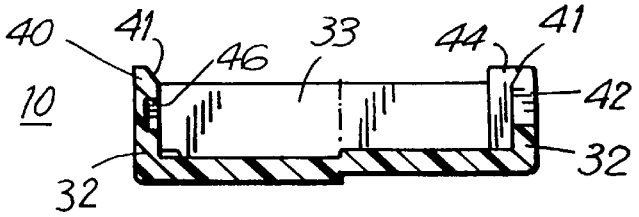
Figure 5:
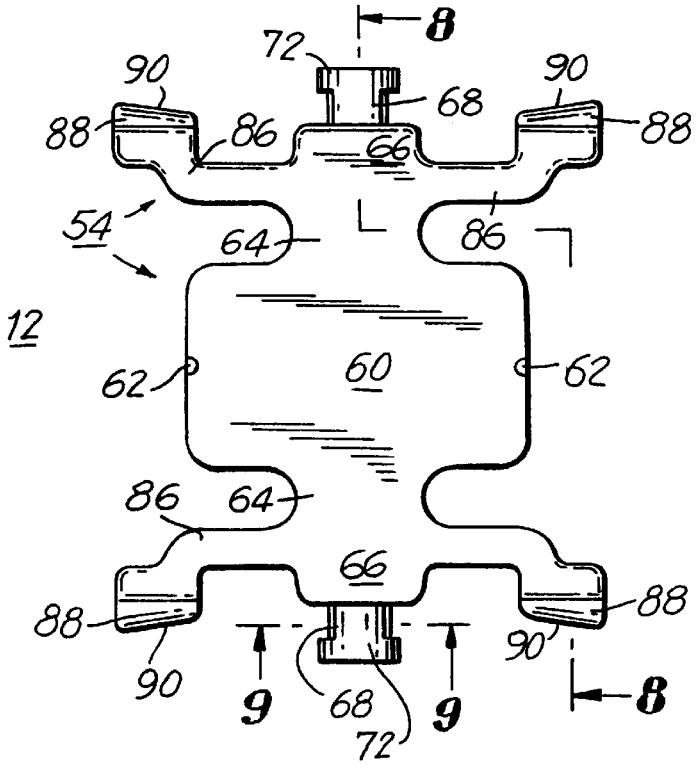
Figure 6:
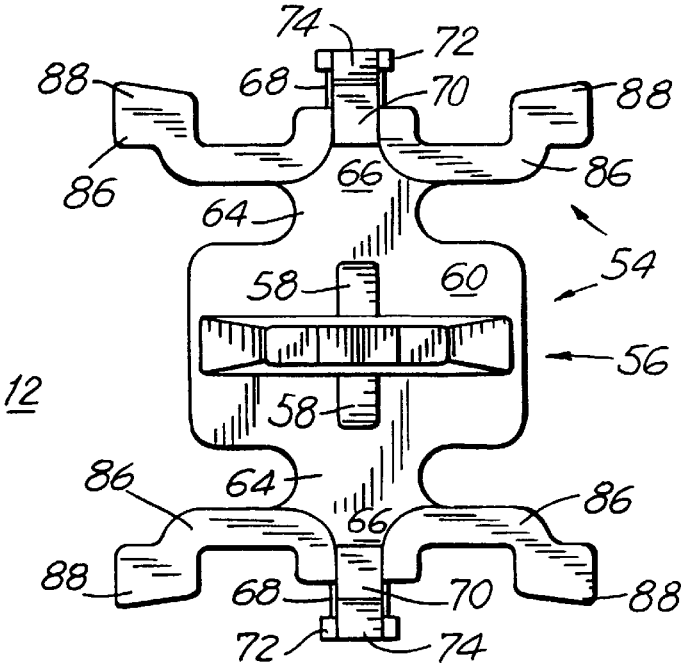
Figure 7:
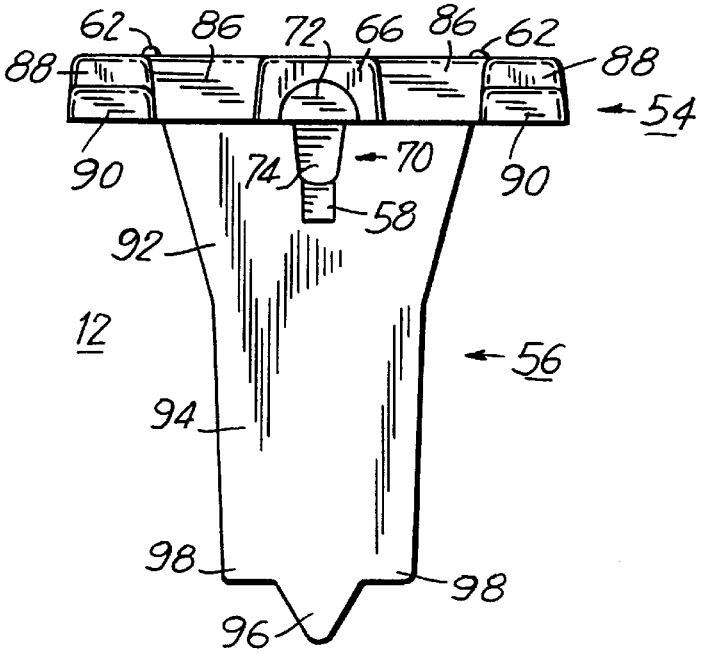

Turning to the details of construction of the rocker cover 10 shown in FIGS. 2 to 4, it may be seen to be butterfly-shaped with a rectangular periphery in plan view defined by relatively short side walls 32 and relatively long end walls 33. The rocker cover 10 is formed to have two symmetrical halves 34 that present, on their upper faces and externally of the installed switch, two substantially rectangular contact surfaces 36, with sides of nearly equal length, that are canted to each other at a small angle that is typically a little less than 10 degrees, for example 9.5 degrees. A center section 38 of the upper, outward face of the rocker cover 10 is smoothly curved concavely about a substantial radius of about 5 inches and about an axis perpendicular to the paper, to join the contact surfaces 36 in an esthetically pleasing manner.

This curvature extends through a significant portion of the length of the rocker cover 10, perhaps 15 to 25%. The overall length of the rocker cover is, in a preferred embodiment suitable for a standard wall box, somewhat over two inches, while the width is about an inch, so that the areas of the contact surfaces 36 are of the order of one square inch each. The whole upper, outwardly presented surface of the rocker cover 10 is smooth, substantially flat except for the contouring just described, and highly polished to provide an attractive appearance and comfortable feel.

The lower edges of the side walls 32 and end walls 33 are substantially coplanar and center portions of the side walls 32 are provided each with a pair of downwardly depending flanges 40 having chamfered inner edges 41 and defining between the members of this pair, an arch-shaped journal slot 42 on each side of the rocker cover 10. Inside the rocker cover 10 each flange 40 is reinforced by a guide post 44 at a point roughly underlying the point of merge between the flat and curved upper surfaces of the cover 10. Each flange 40, or side wall 32, is provided with a rectangular recess 46 just outwardly of the guide post 44. The recesses 46 could, alternatively, be a window through the flange and are intended to mate with cooperative structures of the rocker actuator arm 12. There are a total of four each of the flanges 40, the guide posts 44 and the recesses 46.

The underside of the rocker cover 10 is provided with two shallow square molding depressions 48 underlying the contact surfaces 36 and a central flat portion 50 extending between the guide posts 44 and providing a bearing surface underlying the curved upper surface center section 38. The depth of the depressions 48 can be chosen to provide a desired degree of snapping flexibility in the rocker cover 10. Disposed on each side of the central flat portion 50, midway between the side walls 32, is a small bearing pad 52.

The rocker cover 10 is, in a preferred embodiment, capable of being flexed without cracking both lengthwise and between the centers of the side walls 32, by substantial finger pressure, yet is relatively hard for a plastic material and somewhat rigid.

Figure 8:
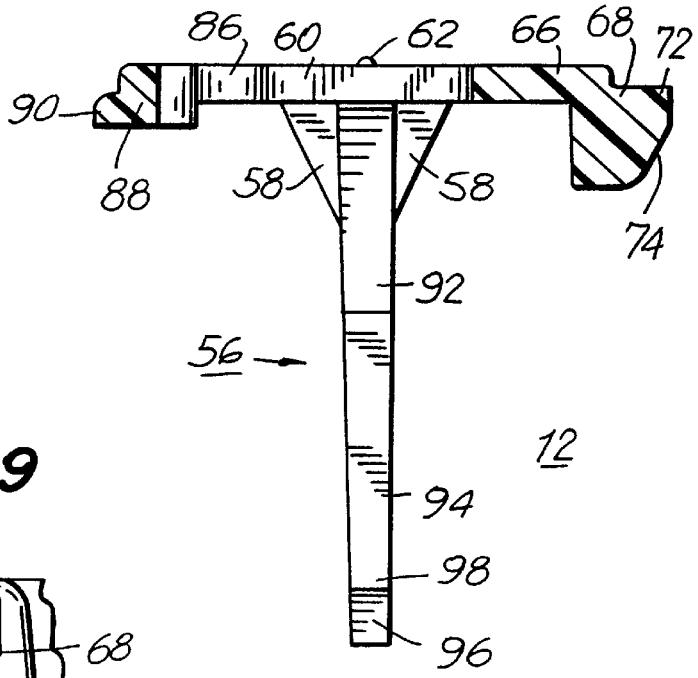

Referring now to FIGS. 5 to 9, the rocker actuator arm 12 is T-shaped in side elevation, as can be seen from the sectional view of FIG. 8, with a generally planar top constituting an anchor plate 54 and an arm portion 56 depending from the anchor plate 54 and stabilized by a pair of buttresses 58. The rocker actuator arm 12 is designed to snap into the rocker cover 10.

With a "spread-eagled" appearance in plan view, the anchor plate 54 is constructed with a central, approximately rectangular bearing portion 60 intended to lie against the central flat portion 50 on the underside of rocker cover 10 to the extent permitted by a pair of small stressing bumps 62 positioned to bear against the bearing pads 52 on the rocker cover 10. The anchor plate 54 extends outwardly from the bearing portion 60 with two reduced neck portions 64 and terminates with a pair of journal plates 66 from which extend short half shafts 68 each of which carries a downwardly depending locator piece 70. Each half shaft 68 terminates in a semicircular pivot boss 72.

Figure 9:
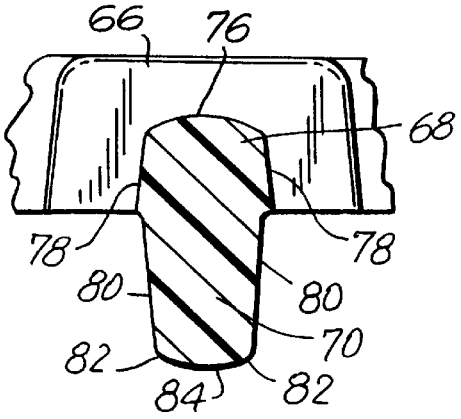
Figure 10:
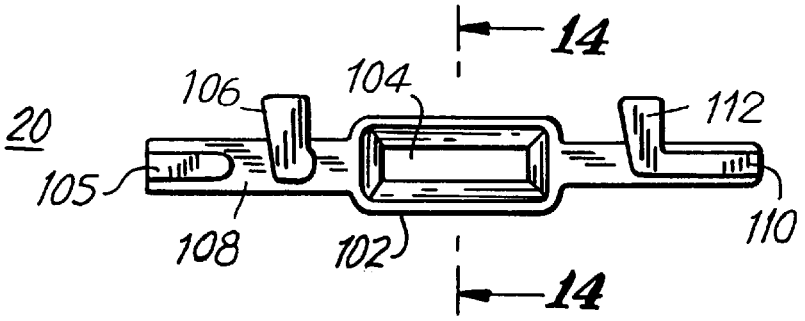
Figure 11:
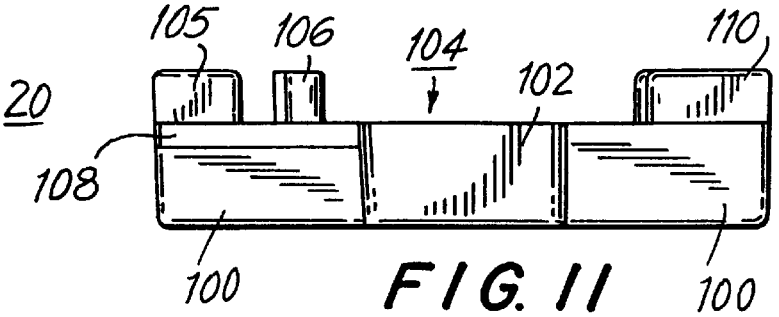
Figure 12:
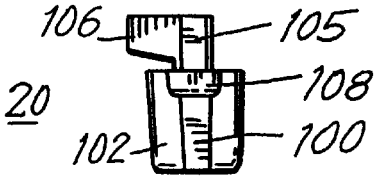
Figure 13:
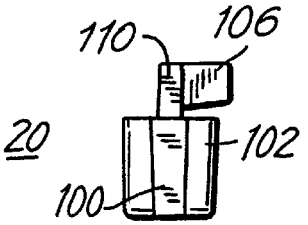
Figure 14:
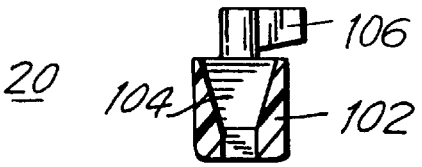

Each locator piece 70 has, in lateral section, as shown in FIG. 8, a cutoff rectangular shape with an outer edge sloping upwardly at an angle that can preferably be about 30 degrees to provide a wedge surface 74 facilitating assembly of the switch. Referring to FIG. 9, each half shaft 68 has, in head-on section, a gently curved top 76 and outwardly tapered sides 78 to be a close or precise fit in the arch-shaped journal slot 42. The head-on section of each locator piece 70 has sides 80 which taper downwardly and inwardly at about 5 degrees each and terminate in sharply curved shoulders 82 between which extends a downward, gently convex bearing surface 84. The overall structure of the journal plate 66, the half shaft 68 and the locator piece 70 is sturdy, capable of repeated use and of bearing substantial loads so as safely to transmit heavy manual pressure placed on the center of the rocker cover 10.

Extending laterally from each journal plate 66 is a pair of outwardly turned L-shaped locking arms 86, four in all, each of which terminates in a stepped foot 88 shaped to engage snugly in a rectangular recess 46 in the rocker cover 10 and each stepped foot 88 has a tapered face 90 providing a camming action to assist assembly. The whole anchor plate 54 is preferably substantially rigid with only a small amount of manual flexing across the locking arms 86 being possible.

The arm portion 56 is also sturdy and substantially rigid with a mildly tapered lateral section, as shown in FIG. 8. The head-on section (FIG. 7) comprises a broader upper portion 92, for strength, which tapers relatively sharply, for example at about 15 degrees, down to a less tapered lower portion 94 which terminates in a triangular rocker cam 96 with a pair of square shoulders 98 alongside it. The rocker cam 96 provides a first cam surface to ride along and interact with a second cam surface on the cam spring 22 (FIG. 1A). The shoulders 98 are set back far enough to ride clear of the cam spring 22 and to ride against the slider 20 to move it to the left or the right. The corners of the shoulders 98 and the point of the rocker cam 96 are somewhat rounded or chamfered to smooth the camming action and the shape of the rocker cam 96 is preferably close to that of an equilateral triangle.

As stated above, the rocker actuator arm 12, as well as the rocker cover 10, are preferably each a single injection molding from a high quality, high-impact thermoplastic material, although a sub-component construction is of course possible within the spirit of the invention.

The rocker actuator arm 12 is designed to snap fit into the rocker cover 10 and can, in a preferred embodiment, provide a surprisingly strong rocker assembly which has virtually no freedom of movement between the components, even with substantial manual leverage applied to the end of the arm portion 56 to rock it. This rocker assembly is also generally T-shaped with the rocker actuator arm 12 projecting perpendicularly from the center of the rocker cover 10 to be about half of the length of the rocker cover 10. A comparable one-piece molding could be expected to be relatively more massive and weighty in order to have equivalent structural strength, especially in the manner of attachment of the base of the rocker arm to the rocker cover 10. The rocker actuator arm 12 is carefully dimensioned to fit or mate closely with the rocker cover 10 and to be capable of achieving switch assembly and operating functions to be described.

To assemble the rocker actuator arm 12 with the rocker cover 10, the latter can be positioned upside down on a support surface. The rocker actuator arm 12 can then be positioned by aligning the half shafts 68 over the journal slots 42 with the pivot bosses 72 closely embracing the outer surfaces of the flanges 40. This alignment is assisted by guide posts 44 which, in addition to providing structural reinforcement, serve to guide the rocker actuator arm 12 into place by engagement with the locking arms 86 or the stepped feet 88 at the ends of the locking arms 86. In this position the feet 88 are lying on the flanges 40. Pressure or a sharp blow on each locator piece 70 in turn drives first one, then the other half shaft 68 to the top of the journal slot 42. In the process the stepped feet are driven into the rocker cover 10 being levered inwardly, flexing the rocker actuator arm 12 or the rocker cover 10 or both, by a camming interaction between the tapered face 90 of each stepped foot 88 and the chamfer 41 on each flange 40. If they have not already done so, the feet 88 can be snapped into the rectangular recesses 46 in the rocker cover 10 by modest downward pressure on the locking arms 86. When all four feet are locked in place, the rocker actuator arm 12 is securely anchored to the rocker cover 10 by a four point loading system which stresses the anchor plate 54 against the stressing bumps 62.

A skilled production engineer reading this description may readily appreciate that the assembly operation just described lends itself easily to automation, the aligned locator pieces 70 being pressed or hit sequentially by a pair of pushers and the locking arms 86 being pressed downwardly by mechanical fingers on a relatively straightforward production machine.

The slider 20 shown in FIGS. 10 to 14 serves to transmit swinging motions received from the rocker actuator arm 12 to one or more movable brush assemblies 26 and is also preferably manufactured as a one-piece injection molding of a material similar to that described for the rocker cover 10 and rocker actuator arm 12. The slider 20 also helps guide and, if necessary, restrain the arm portion 56 as it swings.

The slider 20 has a rather flat body 100 with an enlarged mid-portion 102 encompassing a tapered slot 104 of downwardly tapering rectangular section, through which slot the rocker actuator arm 12 can extend. At its left-hand end, the slider body 100 is formed with a first lengthwise extending rib 105 and a transversely extending left-hand brush pusher 106, both of which project upwardly from a small deck 108. At its right-hand end the slider body 100 is formed with a second lengthwise extending rib 110 which projects upwardly from the body 100 and carries an outlying transversely extending right-hand brush pusher 112 at its inward end.

The tapered slot 104 is dimensioned just to accommodate the arm portion 56 of the rocker actuator arm 12 allowing its swinging motion, preferably without lost motion. Save for a small central part of its movement, the slider 20 is pushed by one or the other of the smoothed or chamfered square shoulders 98 engaging an inside wall of the tapered slot 104. The slider 20, which serves as a brush actuator to transmit motion to open and close the switch contacts, is slidably mounted within the switch base 16 in a position vertically between the rocker cover 10's pivot axis and the spring-engaging end of the rocker actuator arm 12, namely the rocker cam 96. The slider 20, as it is driven back and forth by the arm portion 56 and acts to drive one or the other or both of the pushers 106 and 112 against a movable brush or brushes, as will be described.

As may be seen from a careful reading of FIGS. 1 to 1D, the rocker cover frame 14 comprises a rectangular, relatively shallow open-topped box having a number of interior structures and several depending structures as well as some external locking tangs. The rocker cover frame 14 serves to support and surround the rocker assembly, is mateable with the switch base and includes means to be secured thereto. The rocker cover frame 14 also provides load-transmitting functions and is preferably injection molded in one piece from a high-impact thermoplastic material, such as LEXAN 141, like the components described above.

The rocker cover frame 14 has a pair of side walls 114, end walls 116 and a floor 118. Centrally of the floor 118 the rocker cover frame 14 is formed with a substantial rectangular opening 120, bordered by a substantial lip 122, to accommodate the rocking motion of the wider upper portion 92 of the rocker actuator arm 12. At each end the rocker cover frame 14 is formed externally with a pair of angularly disposed slots 124 defined by outwardly turned tangs 126 which slots are engageable with cooperative structures on the mounting strap 18. Internally at each end are a pair of inwardly facing L-shaped load-bearing stops 128 against the tops of which the rocker cover end walls 33 can engage when the rocker cover 10 is pressed. The closing motion of the rocker cover 10 against the stops 128 can be cushioned or damped by resilient pads 130 between each pair of stops 128 or, for example, by molded protrusions (not shown) on the end walls 116 on the outer sides of the stops 128, which protrusions can be formed on their upper surfaces with one or more thin ribs to absorb the closing load.

Beneath and between the stops 128 there depend, one at each end of the rocker cover frame 14, hollow screw posts 132 formed to receive and lock with the threaded ends of switch assembly screws 134.

The periphery of the floor 118 is formed with four lipped, rectangular openings 136 and 138 positioned along the side walls 114 towards the ends of the rocker cover frame 14 with the near right-hand opening 136 being leftwardly offset as compared with the other three openings 138 because of the ground contact screw therebeneath. Three rectangular flanges 140 depend one from each of the openings 138 and a smaller flange (not shown in the drawing figures) depends from the opening 136. Larger flanges (not shown in the drawing figures) extend across the floor 118 depending from the underside thereof to the left and right of the rectangular opening 120 and serve to constrain the slider 20 against upward movement by engagement with the ribs 105 or 110 thereon. Small off-center posts (not shown) can also be provided on the underside of the floor 118 to engage structures of the switch base 16 either directly or after limited flexing of the floor 118 to transmit loads to the switch base 16 and to assist proper orientation of the parts during assembly, for which purpose they can be positioned both on the same side of a lengthwise center line of the rocker cover frame 14.

At the mid-points of the side walls 114 and the floor 118 rectangular openings 146 are located, and along the inner edges of the side walls 114, there are sturdy bearing seats 148. If desired, the floor 118 can be slotted lengthwise (not shown) of the openings 146 so as to flex under loads applied to the bearing seats 148 and to assist desired outward flexing of the side walls 114 during assembly of the switch. Each bearing seat 148 comprises a small wall having a central elongated depression 150 on its upper surface shaped to cooperate with the convex bearing surface 84 of the locator piece 70 on the rocker actuator arm 12, and comprises strengthening and locating shoulders 152 at the ends of the depression 150. Where the floor 118 is slotted, as described, its resultant limited resilient flexibility can be used to urge the bearing seats 148 upwardly.

The side walls 114 are formed at their mid-points, alongside the openings 146 and opening thereinto, with arch-shaped recesses 154 which taper outwardly and downwardly and are shaped at their upper ends to receive the pivot bosses 72 on the anchor plate 54 of the rocker actuator arm 12 for pivotal contact therewith. Preferably, these upper ends of the recesses 154 are curved and shaped just to accommodate the semicircular pivot bosses 72 for rolling contact throughout the range of desired pivotal movement. For this purpose, the upper end curvature of the recesses 154 may be modestly greater than that of the pivot bosses 72.

The rocker assembly comprising the rocker actuator arm 12 snapped into the rocker cover 10 can readily be further assembled with the rocker cover frame 14 by passing the rocker arm portion 56 through the central rectangular opening 120, aligning the rocker assembly centrally over the rocker cover frame 14 with the half shafts 68 and pivot bosses 72 overlying the side walls 114 of the rocker cover frame 14, then pressing the rocker assembly downward firmly to snap it into the frame 14. The wedge surfaces 74 on the underside of the locator pieces 70 on the rocker actuator arm 12 drive the side walls 114 of the rocker cover frame 14 apart under this downward pressure to admit the pivot bosses 72 into the arch-shaped recesses 154 allowing the side walls 114 to snap back to their normal shapes. In the process, locator pieces 70 are pressed down to engage in the depressions 150 in the bearing seats 148 so that the rocker assembly is securely located in the rocker cover frame 14 by this interaction on the one hand, and the engagement of the tops of the arch-shaped recesses 154 with the pivot bosses 72 on the other hand. The rocker assembly is thus securely supported for a pivoting or rocking action about the pivot bosses 72 while the locator piece 70 can slidably move in the depression 150 in the bearing seats 148.

Preferably, the detailed dimensions and design are such that there is little lost motion or play in moving the rocker assembly vertically (in the sense of FIG. 1A) between the depression 150 and the recess 154 in the rocker cover frame 14. However, there should be enough freedom to allow the pivoting and sliding movement described. Thus, it is important that the spacing of the upper surface of each pivot boss 72 from the convex bearing surface 84 on the underside of the locator piece 70 be closely matched to the spacing of each depression 150 from the top of each recess 154. Limited resilient flexibility of the floor 118 provided by the described slotting can help achieve these ends by urging the bearing seat 148 and the locator piece 70 upwardly to a selected degree.

Again, those skilled in the art of production processes will appreciate that the construction of the several components described so far has been ingeniously devised to allow for simple, readily automated assembly steps including the straightforward pressing of the rocker assembly into the rocker cover frame 14, as just described.

When thus mounted in the rocker cover frame 14 the rocker actuator arm 12 depends therefrom to swing about either side of a center plane (not shown in the drawing figures) which includes a pivot axis passing through the pivot bosses 72 and is perpendicular to the upper edges of the side walls 114 of the rocker cover frame 14. In the center of its swinging movement about this pivot axis, the apex of the rocker cam 96 lies in this plane 155 and the arm portion 56 swings to either side of the plane. When depressed, each contact surface 36 of the rocker cover 10 lies approximately flush with the upper edges of the side walls 114 and the end walls 116 of the rocker cover frame 14, which can, if desired, be in a plane with a switch plate, not shown, so that the switch depresses in a pleasingly flush manner to such a switch plate. The rocker cover 10 and rocker actuator arm 12 are in all or most respects symmetrical about this center plane, as is the rocker cover frame 14 with regard to its major structures.

The switch base 16, which has something of the overall shape of a bathroom tub, receives inwardly the downwardly depending structures of the rocker cover frame 14 in mating engagement therewith; accommodates the slider 20, the rocker cam spring 22, the brushes 24 and 26 and the wire clamp assemblies 28 and 30 as well as the downward end of the arm portion 56 of the rocker actuator arm 12; and is snugly engaged on its outer surfaces by the mounting strap 18.

For these and other purposes which will be described or may be read or inferred from the drawings as they are understood in the light of this specification, the switch base 16 is provided with three longitudinally extending (left-to-right) chambers: a near side, movable brush chamber 156, a central, slider chamber 158 and a far side fixed brush chamber 160. Throughout most of their length these three switch base chambers 156, 158 and 160 may be envisioned as having more or less rectilinear cross-sections subject to the intrusion of several components, as will be described, and rather complex shapes, the highlights only of which will be described, while other details, if necessary, can be read from the drawings, it being understood that substantial variations in the shapes and configurations of the switch base 16 and these chambers are quite possible while meeting the objectives of this invention. The upper limits of these chambers 156, 158 and 160 are usually open so far as the switch base 16 is concerned, and are thus delimited by the undersurfaces of the rocker cover frame 14 while the lower limits are closed, except as otherwise described, by a switch base skin 162.

The near side movable brush chamber 156 is, in this particular embodiment of a single-pole switch, provided with the single front clamp assembly 30 to receive which the skin 162 has a rectangular opening in the side of the chamber 156 defined between longer and shorter upright grooved rails 164 and 166. Other embodiments, some of which will be described, can have a plurality of such structures for a plurality of clamp assemblies 30.

The brush chamber 156 and the slider chamber 158 have a common low, perhaps half-height, lengthwise dividing wall 168. Between this dividing wall 168 and the upright rails 164 and 166 there extends a pair of transverse walls 170 which serve to stiffen the base 16 and cooperate with the other structures thereof electrically to isolate the clamp assembly 30 and to provide a means to assist in guiding a wire into the clamp assembly 30. On at least one side of the clamp assembly 30 the switch base 16 is inwardly undercut, as at 172 on the left, to reduce the volume occupied by the switch and to increase the space the switch can leave available in a wall box.

Directly beneath the clamp assembly 30 and on the underside of the switch base 16 is a semicircular wire-receiving collar 174 dimensioned closely to accommodate a standard insulated wire and centrally of the collar 174 the switch base skin 162 has a notch 176 beneath the opening between the rails 164 and 166 and adjacent the shorter rail 166 through which notch 176 a stripped conductor wire can access the clamp assembly 30 to which it is directly guided by the transverse wall 170. The depth of the collar 174 provides a short channel that can safely accommodate a small excess of stripped conductor and electrically isolate it, especially from the mounting strap 18.

The right-hand end of the movable brush chamber 156 terminates short of the end of the switch base 16 in order to accommodate a grounding terminal for which purpose the exterior of the switch base 16 is furnished with structures designed to cooperate with and engage the mounting strap 18. These structures (FIG. 1D) comprise a right-angled vertically extending indent 178 terminating in an approximately square overhang 180 slotted at 182 to allow passage of a finger on the mounting strap 18 into one of the slots 124 in the rocker cover frame 14; a chamfered lip 184 on the underside of the overhang 180; and a vertically extending angled end plate 186 which cuts back across the indent 178 and is capped by the overhang 180. The chamfered lip 184 serves to guide and retain the grounding terminal (on the mounting strap 18) into position, as will be described further, hereinafter.

The centrally disposed slider chamber 158 is dimensioned to accommodate the slider 20 for easy lengthwise movement and a small amount of lateral play. The chamber 158 is defined between the (near) dividing wall 168 and a second, far dividing wall 188 common to the fixed brush chamber 160 and is also a low, perhaps half-height, lengthwise extending wall. Towards its left-hand end the slider chamber 158 has a transverse wall 190 extending between the dividing walls 168 and 188. If desired, a pair of substantial cylindrical, load-transmitting posts that can protrude into the adjacent brush chambers 156 and 160 and be integrated each with a dividing wall 168 or 188, can be provided to assist in strengthening the switch base 16 and to engage the understructure of the rocker cover frame 14. The transverse wall 190 has an upwardly opening stepped-V-shaped cutout 194 dimensioned to accommodate the left-hand end of the slider body 100 and the small deck 108. Near its right-hand end the slider chamber 158 has a pair of vertical abutments 196 defining a slot 198. The near one of the abutments 196 can be backed by a third load-transmitting post which is also integrated with the dividing wall 188 while the far abutment 196 is integrated with the dividing wall 188 without a post. The slot 198 between the abutments 196 is wide enough to accommodate the right-hand end of the slider body 100 for free sliding movement but is substantially narrower than the deck 108 at the left-hand end of the slider to provide a keying arrangement that ensures the slider is oriented as shown when the switch is assembled. It is to be noted that the slider is asymmetric and would not operate satisfactorily if turned 180 degrees, even if the structure permitted.

Slider bars 200 and 202 extend across the bottoms of the cutout 194 and the slot 198 respectively and are engaged by the bottom surface of the slider 20 slidably to support it and locate it with its upper body surface substantially parallel with the tops of the dividing walls 168 and 188 so that the outlying sliders 106 and 112 can clear or run freely on the far dividing wall 112, as the slider slides.

End walls of the slider chamber 158 are defined by hollow cylindrical screw pillars 204 dimensioned telescopically to receive the hollow screw posts 132 that depend from the rocker cover frame 14. Where the screw pillars 204 emerge at the underside of the switch base 16 they have peripheral lips 206 for slidably receiving the assembly screws 134.

The left-hand screw pillar 204 is furnished with a vertical strengthening flange 208 that merges into the near dividing wall 168 while the right-hand pillar 204 merges with the switch base skin 162 at the indent 178 to provide a sturdy load-transmitting structure in conjunction with the vertical corner of the indent 178. A small post depending from the rocker cover frame 14 can be positioned to engage the flange 208 to prevent assembly of the switch base 16 to the rocker cover frame 14 with an improper orientation.

Directly beneath the center of the slider chamber 158 and opening thereinto throughout its length is a spring chamber 210 for the rocker cam spring 22 which spring chamber 210 is shallow, is of rectangular section and is disposed beneath the path of the rectangular opening 120 in the slider 20 so that the lower portion 94 of the rocker actuator arm 12 can engage the spring 22 throughout its movement. The spring chamber 210 is centrally and symmetrically disposed with regard to the center plane 155 and extends substantially between the slider bars 200 and 202. In this particular embodiment, the spring chamber 210 is longer than the spring 22, allowing the spring 22 to move lengthwise, to float. To assist this floating and to facilitate desired configurations of the spring 22, the spring chamber 210 is provided with transverse rails 212 spaced towards the ends of the spring chamber 210 and defining therein end pockets 214. The overall length of the chamber 210 depends upon the length of the spring 22 and the desired degree of float which can, for example, be about 10 to 15% of the length of the spring.

The walls of the spring chamber can, as shown, be formed integrally as part of the switch base skin 162, or alternatively can be formed as a removable bolt-on unit enabling the spring 22 to be changed for one of a different conformation or strength, or to be replaced when worn, or allowing a different spring chamber 210 to be attached without disassembling the rest of the switch.

Externally, the spring chamber 210 provides a small long spring box 216 protruding downwardly from the bottom face of the switch base 16. The spring box 216 can be provided with a strip gauge comprising a small nose 218 projecting lengthwise from the spring box 216 and a longitudinal depression 220 in the outer surface of the spring box 216 and aligned with the nose 218. A stripped wire can be laid against the depression 220 with its insulation against the nose 218 and marked or cut to the length indicated, being a length that can be properly secured in the clamp assemblies 28 or 30 without excess bared conductor wire. If desired, informational lettering can be molded on the bottom surface of the spring box 216. This nose 218 also serves as a key to orient the switch box 16 as it is assembled with the mounting strap 18 by engaging with a notch therein. The undersurface of the switch base 16 is also provided with raised side edges 222 stepped at 224 for locating the switch base 16 in engagement with the mounting strap 18. Two tapered bumps 226 on the end faces of the switch base 16 enable the mounting strap 18 to snap into engagement with the switch base 16 by cooperating with openings therein. The four outer corners of the switch base 16 are cut off to provide angled faces 228, one of which is an outer face of the angled end plate 186, to clear projecting fingers on the mounting strap 18 during assembly and to promote compactness of the switch.

The far side fixed brush chamber 160 is, in this particular embodiment of a single-pole switch, provided with the single rear clamp assembly 28 which comprises the skin 162 which has a rectangular opening in the side of the chamber 160 defined between longer and shorter upright grooved rails 230 and 232 at the right-hand end of the fixed brush chamber 160. Other embodiments, some of which will be described, can have a plurality of such structures for a plurality of clamp assemblies 28.

Between the dividing wall 188 and the shorter grooved rail 232 there extends a transverse wall 234 which serves to stiffen the base 16 and cooperates with the other structures thereof electrically to isolate the clamp assembly 28. The transverse wall 234 defines on its left-hand side a contact sub-chamber 236 of approximately square horizontal section while the remainder of the fixed brush chamber 160 is inwardly undercut at 238 to strengthen the switch base and to reduce the volume occupied by the switch thereby to increase the space available in a wall box.

Directly beneath the clamp assembly 28 and on the underside of the switch base 16 is a semicircular wire-receiving collar 240 similar to the collar 174 and dimensioned closely to accommodate a standard insulated wire. Centrally of the collar 240 the switch base skin 162 has a notch 242 beneath the opening between the rails 230 and 232 and adjacent the longer rail 230 through which notch 242 a stripped conductor wire can access the clamp assembly 28. A short transverse wall extension, or flange 244 serves to guide a stripped conductor wire directly into the clamp assembly 28.

As previously mentioned, the switch base 16 is also preferably manufactured by injection molding from a high impact thermoplastic material such as LEXAN 141 and it has been designed with this end in view. However, while the rocker cover 10 and the rocker cover frame 14 may be able to flex to some degree in one direction or another, under manual pressure, it is preferred that the switch base 16 be substantially rigid throughout. In general, its outer edges and corners are rounded or have small flat surfaces for good feel and to assist assembly, especially with the mounting strap 18.

Figure 1C:
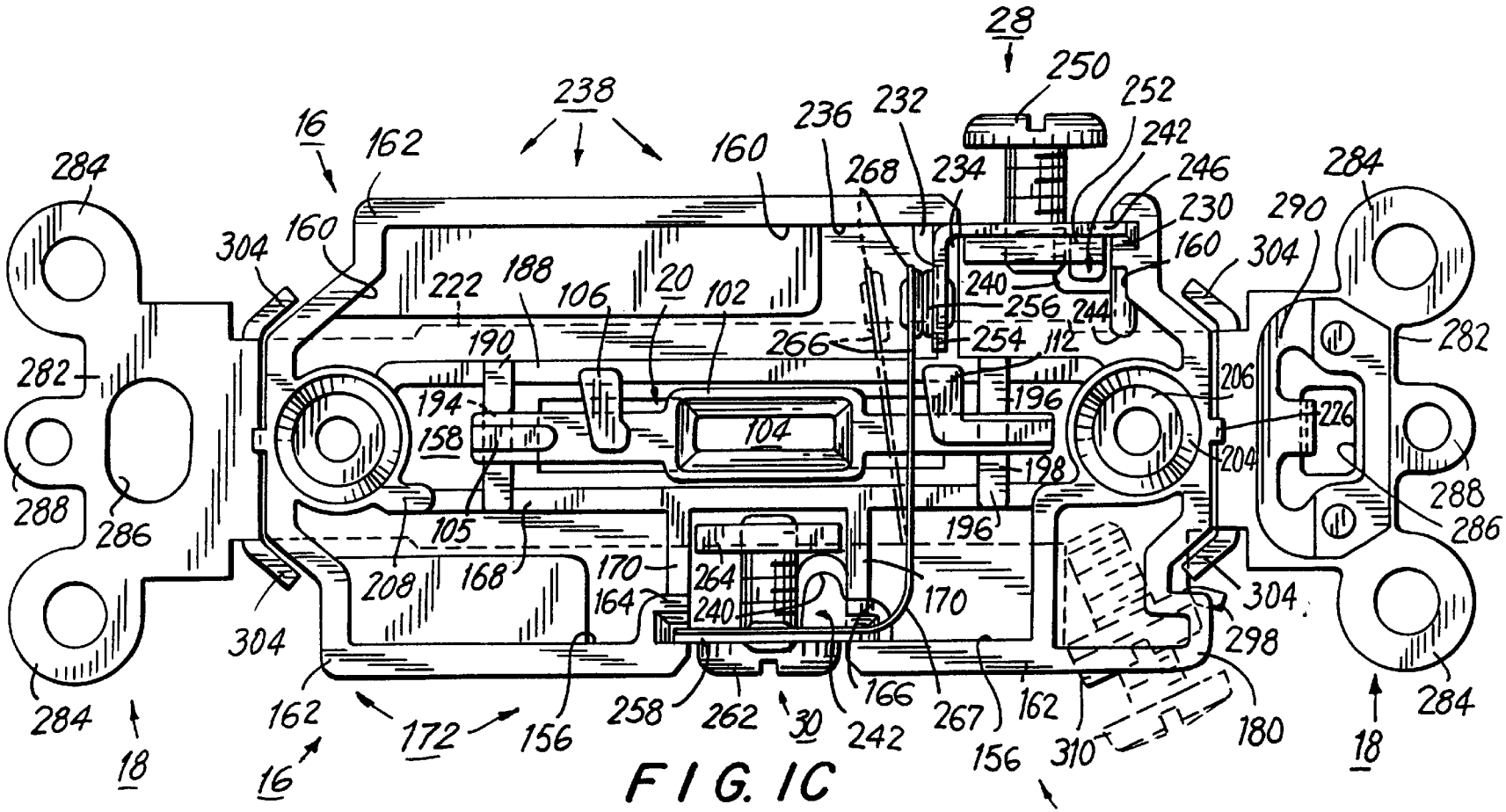
FIG. 1C is a top plan view similar to FIG. 1 of the switch base and strap shown therein, also without the rocker assembly.

As best shown in FIG. 1C, the terminal assembly 24 comprises a flat terminal plate 246 that is a close sliding fit between the rails 230 and 232 for assembly purposes, and is approximately the height of the opening between them so as to be clamped in place by assembly of the switch base 16 with the rocker cover frame 14. The lower half of the terminal plate 246 has a downwardly opening slot (not visible) to receive the clamp assembly 28. The clamp assembly 28 comprises an enlarged-head clamp screw 250 extending through the slot and engaging in a threaded hole in a rectangular, ribbed clamp plate 252 disposed on the inward face of the terminal plate 246. A conductor wire received upwardly through the notch 242 is clamped between the clamp plate 252 and the terminal plate 246. The upper half of the terminal plate 246 is formed integrally with a rectangular flange 254 extending perpendicularly inwardly of the terminal plate 246 and carrying a fixed button contact 256 riveted to the flange 254. The flange 254 can rest on the transverse wall 234 for additional stability and to locate the button contact 256 in the contact sub-chamber 236.

The movable brush assembly 26 comprises a flat terminal plate 258 that closely slidably fits into the rails 164 and 166 for assembly purposes, and is approximately the height of the opening between them so as to be clamped in place by assembly of the switch base 16 with the rocker cover frame 14. The lower half of the terminal plate 258 has a downwardly opening slot (not visible) to receive the clamp assembly 30 which comprises an enlarged-head clamp screw 262 extending through the slot and engaging a threaded hole in a rectangular, ribbed clamp plate 264 disposed on the inward side of the terminal plate 246. A conductor wire received upwardly through the notch 176 is clamped between the clamp plate 264 and the terminal plate 258. The upper half of the terminal plate 258 is riveted to a resiliently movable brush arm 266 which has a nearly rectangular bend 267 where it leaves the terminal plate 258 and then extends across the switch base 16 into the contact sub-chamber 236 where the brush arm 266 carries, at its outer end, by means of a rivet, a movable button contact 268. In the position shown in FIG. 1A with the rocker cover 10 depressed at its left-hand end, and the slider 20 moved to the right, the movable brush arm 266 extends between and well clear of the rocker actuator arm 12 and the right-hand brush pusher 112 on the slider 20 and clear of the body 100 of the slider 20 but well aligned with the left-hand face of the pusher 112 for engagement thereby. The movable button contact 268 is aligned as squarely as possible with the fixed button contact 256 and is movable on an arcuate path as the brush arm 266 swings or is flexed, due to its resilience, about a substantially vertical axis or axes in the vicinity of its bend 267. In an unobstructed rest position, the movable button contact 268 is resiliently urged into contact with the fixed button contact 256. As the brush arm 266 is swung into an open position it moves into and through a perpendicular position where the bend 267 is at 90°. Preferably, the left-hand vertical faces of the pushers 106 and 112 are tilted about a vertical axis to engage squarely against a brush arm 266 (only one shown) in its open position, thereby to smooth the action of the switch and facilitate control of the movement of the button contact 268.

The materials of the clamp assemblies 28 and 30, the brush assembly 26 and the terminal assembly 24 are all conductive so that a circuit can be completed between conductor wires held in the clamp assemblies 28 and 30. Preferably, these conductive components are all of substantial grade, and good quality electrical materials are used so that substantial currents, for example 10 or 20 amperes, can repeatedly be carried for extended periods of time without significant heat generation, electrical losses or excessive arcing. Such materials include silver alloys for the button contacts 256 and 268, a beryllium copper alloy for the brush arm 266, and brass for the remaining conductive components.

The wire clamp assemblies 28 and 30, together with the switch base 16 are designed either for easy internal back wiring through the notches 176 or 242 in the switch base 16, employing the strip gauge comprising the depression 220 and the small nose 218 on the underside of the switch base 16, if desired, or for external side wiring under the heads of the clamp screws 250 and 262.

The rocker cam spring 22 is a leaf spring pressed to shape out of flat resilient steel strip, preferably stainless steel, and has the profile shown in FIG. 1A. The particular profile of the spring has a substantial effect on the movement and feel of the rocker switch as will be explained more fully subsequently. Referring to its profile, the spring 22 is symmetrical about a center apex 270 from which a short cam portion 272 extends downwardly on each side of the apex 270 at an obtuse angle to each other, to an inflection with a longer support portion 274 which overlies a rail 212 and terminates in a turned-under or folded under, outer end portion 276 in each end pocket 214 of the spring chamber 210. The apex 270 is relatively sharp which is to say that the flat surfaces of the cam portions 272 are joined by a curved spring portion of small radius to provide somewhat of a surface discontinuity rather than a smooth transition in proceeding from one cam portion to the other. Preferably, the spring chamber 210 and the slider chamber 158 are charged with an insulative, viscous grease for lubrication and damping.

As the switch is operated, for example by pressing downwardly on the right-hand side of the rocker cover 10 in the position shown in FIG. 1A, the rocker cam 96 on the lower portion 94 of the rocker actuator arm 12 presses against the right-hand cam portion 272 of the rocker cam spring 22, depresses and deforms it against its resilience until the apex 270 of the spring passes to the right beneath the rocker cam 96, and the whole spring is driven to the right by the camming action between the rocker actuator arm 12 and the rocker cam spring 22 as the spring rebounds. The switch is then held with the rocker actuator arm 12 and the cam spring 22 in the mirror image positions of those shown in FIG. 1A.

The switch base 16 is assembled with the rocker assembly snapped into the rocker cover frame 14, simply by guiding the downwardly depending hollow screw posts 132 on the underside of the rocker cover frame 14 into the hollow screw pillars 204 of the switch base 16 and this telescopic interengagement, which preferably tightens as the parts close together, locates the switch base 16 exactly in alignment with the rocker cover frame 14. As described above, proper end-for-end orientation can be assured by one or more small, off-center posts (not shown) depending from the rocker cover frame 14.

Figure 15:
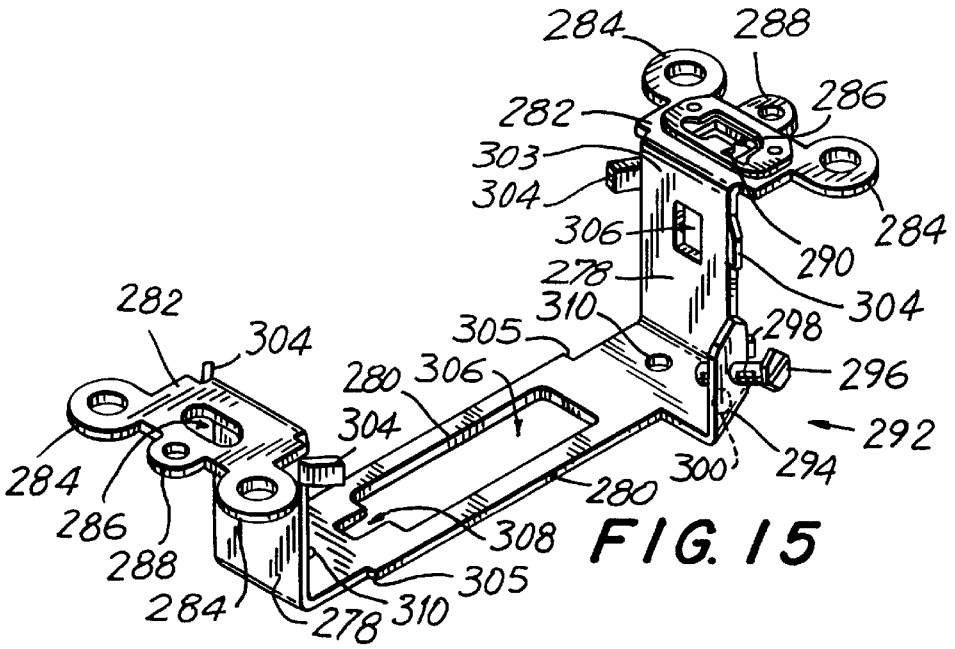

The mounting strap 18 shown in full in FIG. 15 and in part in FIGS. 1 to 1D, is preferably stamped and pressed in one piece from a substantial gauge sheet steel. Suitable sheet steel can be stainless, and preferably is somewhat flexible but has low resilience so as to be deformable to mate closely with the switch and against a wall and wall box, as desired. The mounting strap 18 has a U-shaped body with short side flat surfaces 278 extending perpendicularly from the ends of a longer back flat surface 280. Each side flat surface 278 bears an end flange 282 turned down at right angles to it.

Each end flange 282 has a pair of outwardly projecting apertured plaster ears 284 by means of which the strap 18 can be secured to a wall or other surface and an elongated slot 286 located inwardly between the ears for mounting and centering in a wall box with mounting screws, not shown. A further, central lobe 288 having a threaded aperture on each end flange 282, provides means for securing a switch plate (not shown) around the switch. A mounting-screw clamp 290 on one end flange 282, partially overlying the slot 286, can be provided to ensure a ground connection between the mounting strap 18 and a grounded metal wall box.

For use with 3-wire systems which employ plastic or other insulating wall boxes and make ground connections through the third wire, the mounting strap 18 is provided with a grounding terminal 292 comprising an apertured flange 294 perpendicularly upturned from the back flat 280 and angled to the line thereof to lie along the angled face 228 provided on the outside of the switch base 16 for that purpose. The grounding terminal 292 also includes a grounding clamp screw 296 and can be provided with a guide tongue 298 to push a ground wire under the grounding clamp screw 296 and an opening 300 in the base of the flange 294 through which opening 300 the bared end of a ground wire may be tidily and safely stowed in the cavity defined between the grounding terminal 292 and the switch base 16.

Each side flat surface 278 has a rectangular opening 302 (one visible) towards its upper end to snap over one of the tapered bumps 226 on the outside of the switch base 16 which opening 302 defines, with each end flange 282, a land 303 (one visible) at the end of each side flat surface 278. Projecting outwardly from each land 303 are a pair of fingers 304 which are designed to engage in the angularly disposed slots 124 in the rocker cover frame 14.

The back flat surface 280 is shaped to fit snugly against the bottom of the switch base 16 and has outer edges stepped at 305 to mate with the side edges 222 (which are themselves stepped at 224) of the switch base 16. A central rectangular opening 306 has a cutout 308 in an end remote from the grounding terminal 292 to fit closely around the spring box 216 and the small nose 218 that projects therefrom. This interfitting arrangement serves to orient the switch base relative to the mounting strap 18, as previously described.

Towards its ends, the back plate 280 has screw holes 310 for the switch assembly screws 134. The mounting strap 18 is preferably pre-formed with some narrowing to bring the upper ends of the side flats 278 towards each other by a small amount out of the vertical to assist assembly. If desired the back flat surface 280 or the side flat surfaces 278 or both can be corrugated or otherwise shaped to strengthen the mounting strap 18.

The final switch assembly step comprises pressing the previously described compact and self-supporting switch base-and-rocker assembly of the rocker assembly, the rocker cover frame 14 and the switch base 16 including the several components the switch base 16 carries, downwardly into the cradle formed by the two side flat surfaces 278 and the back flat surface 280 of the mounting strap 18. If necessary, the switch base 16 may push or pry the side flat surfaces 278 apart sufficiently to admit the switch base and have the side flat surfaces 278 bear resiliently against the switch base 16. As the switch base 16 moves into the mounting strap 18, the four outwardly extending fingers 304 embrace or engage the four vertical angled faces 228 on the outside of the switch base 16 and the parts slide together until the tapered bumps 226 engage the mounting strap 18. Further pressure, possibly accompanied by some outward tensioning, causes the tapered bumps 226 to push the side flats 278 apart and move across the land 303 juxtaposing the spring box 216 with its projecting nose 218, on the bottom of the switch base 16, with the rectangular opening 302 and the cutout 308 in the back flat surface 280 on the mounting strap 18. If properly oriented, in an end to end sense, the spring box 216 and nose 218 can mate with and enter the opening 302 and cutout 308. Otherwise the switch base and rocker assembly must be withdrawn from the mounting strap 18, and the parts reoriented.

This mating of the spring box 216 and nose 218 with the opening 302 and cutout 308 serves to locate the switch base 16 and mounting strap 18 quite accurately and helps guide the fingers 304 on the mounting strap 18 into the angularly disposed slots 124 on the rocker cover frame 14 which become juxtaposed just after the spring box 216 begins to enter the opening 306, while the tapered bumps 226 are still riding on the lands 303.

Further movement, possibly accompanied by some inward pressure on the side flat surfaces 278 or the end flanges 282, causes the tapered bumps 226 to complete their movement across the lands 303 and to snap into the openings 300 to lock the mounting strap 18 onto the switch base and cover assembly to provide a switch assembly ready for packaging distribution and sale. This further movement also brings the upper edge of the apertured flange 294 of the grounding terminal 292 on the mounting strap 18 into position behind the chamfered lip 184 on the overhang 180 of the switch base 16, with guiding engagement, if necessary.

In FIG. 1 there is shown an optional feature of the invention, namely a switch light or illumination means lying in the rocker cover frame 14 and comprising an integral resistor bulb assembly having a low wattage bulb 320 and a voltage dropping resistor 322 in series therewith connected by insulated conductor wires 324 to contacts 326 and 328. In such an illuminated embodiment, the rocker cover 10 is somewhat translucent to pass light from the bulb 320.

The switch assembly described can readily be installed in a standard wall box or other suitable device. The two (black) hot wires are connected to the rear and front wire assemblies 28 and 30, preferably by backwiring, as previously described, and preferably with the live hot wire connected to the rear contact assembly 28 which carries the fixed terminal assembly 24. A ground wire, if provided, is attached to the ground terminal 292, as described and the wires and switch are packed into the wall box to which the switch is secured by bolts through the elongated slots 286, using a mounting screw clamp 290 if no ground wire was connected. A switch plate can then be installed by means of screws into the screw holes 310 in the mounting strap 18.

In normal operation, a user can press, tap, pat or brush the raised right-hand contact surface 36 on the switch's rocker cover 10, quite gently, to move it downwardly (in the sense of FIG. 1A, more likely horizontally in practice) through about 9.5° until the right-hand rocker cover end wall 33 rests against the right-hand stop 128 in the rocker cover frame 14 and the right-hand contact surface 36 is now flush with the upper edges of the side walls 114 and end walls 116 of the rocker cover frame 14. Because the rocker actuator arm 12 forms a substantially rigid assembly with the rocker cover 10, this rocker assembly pivots as though it were a single component about a pivot point defined by engagement of the pivot bosses 72 with the upper surfaces of the arch-shaped recesses 154. Careful dimensioning, as described, enables this to be achieved in a smooth, easy manner with a light, but solid feel.

As the right-hand side of the rocker cover 10 is depressed, the rocker actuator arm 12 swings from right to left, through an angle equal to the angle of pivoting and to the angle of movement of the rocker cover 10 as the left-hand surface 36 is depressed. Since this angle is preferably rather small for esthetic and ergonomic purposes, 9.5 or about ten degrees, the lateral displacement of the rocker actuator arm 12 as it swings, is also rather small, but increases proportionately downwardly along the length of the arm portion 56.

As the arm portion 56 swings from right to left, the lower portion 94 moves the slider 20 to the left by sliding or camming engagement with the tapered slot 104 in the slider 20. The moving slider 20 causes the right-hand pusher 112 to engage the brush arm 266, bending it back against its resilience, preferably past the perpendicular, to separate the button contacts 256 and 268, and open the circuit between the wire clamp assemblies 28 and 30.

Depending upon the details of construction, the movement of the slider 20 is arrested either by termination of the rocking movement by engagement of the rocker cover 10 with a stop 128, or by engagement of the slider body 100 with one of the screw pillars 204 of the switch base 16, though the former is to be preferred, being less stressful to the motion-transmitting components of the switch.

The aforedescribed swinging of the rocker arm portion 56 from right to left is controlled by camming engagement of the rocker cam 96 at the downward end of the rocker arm portion 56 with the upper surface of rocker cam spring 22. In broad terms, the rocker cam 96 moves from right to left against increasing resistance from the spring 22 as the rocker cam 96 depresses the center apex 270 of the spring 22 while the left-hand end portion 276 of the spring is stopped against an end wall of the spring box 216. The parts move from the broken line positions shown in FIG. 1A to the solid line positions.

After the rocker cam crosses the apex 270, at which moment the apex is substantially depressed, as shown in broken outline, the resilience of the spring 22 returns the spring to its normal shape and drives it to the right with a camming action between the right-hand short cam portion 272 of the spring 22 and the rocker cam 96 until the folded left-hand end portion 276 of the spring 22 engages the left-hand transverse rail 212 of the spring box 216 where the lengthwise resilience of the spring end 276 due to its folding, cushions the impact. This camming action displaces the center apex 270 of the spring 22 to be off-center to the right with regard to the center plane 155 by an amount equal to half the movement of the spring 22. The rocker cam 96 is off-center to the left with regard to the center plane 155 by a similar distance. Here the apex 270, restored to its normal height, serves to lock or latch the rocker cam 96 in its leftmost position against whichever stop is limiting movement of the rocker assembly, preferably one of the stops 128 in the rocker cover frame 14. Light pressures on the raised, right-hand contact surface of the rocker cover 10 are repelled by the spring 22.

More subtle effects also occur. The provision of a floating spring 22 capable of lengthwise movement as the switch is operated slows down the switch operation, giving the switch a better feel and at the same time producing a low energy arc at the contacts 256 and 268 when they open. The arc energy is lower than that of a comparable faster acting switch and is more desirable, producing less contact wear, and less corrosion or burning, improving the life of the switch.

The floating spring 22 provides a very well controlled switch action by increasing the proportion of switch travel that is performed by human hand and decreasing that performed by the spring 22. This is a valuable consequence of moving the spring apex 270 to an off-center position. When the rocker cam 96 reaches the apex 270, manual operation ceases to influence the speed of the switch which speed is then controlled by the spring 22. The off-center displacement of the apex 270 from the center plane 155 is equal to half of the total floating distance of the spring 22 and equal to the extra added hand operation of the switch in either direction. The switch has a pleasantly positive action without an unduly heavy spring loading to overcome.

Depressing the now raised left-hand contact surface 36 of the rocker cover 10 swings the rocker actuator arm 12 and the rocker cam 96 from left to right while the spring 22 moves from right to left and the parts adopt the solid line positions in FIG. 1A. The slider 20 moves from left to right under the influence of the swinging rocker arm lower portion 94 and of the movable brush arm 266 until the movable button contact 268 closes against the fixed button contact 256.

Many other configurations of the rocker cam spring 22 are of course possible within the spirit of the invention and which are capable of providing the desirable floating action described. For example, the end portions 276 instead of being folded under as described and shown, could simply be an open V-shape having a first arm portion extending downwardly from one of the support portions 274 and a second arm portion extending upwardly from the first. This configuration also provides lengthwise resilience for cushioning.

Excellent results can also be obtained with profiled leaf springs that do not float lengthwise but are constrained in a modified spring chamber 210 that is a close fit to a modified spring 22. Such a spring chamber does not require the transverse rails 212 that help keep a floating spring properly located. A suitable spring profile for use with a single-throw, maintained contact switch, according to the invention, has a large-radius apex providing a substantially continuous cam surface that can feed under the cam tooth 96 as it moves through its center position.

All embodiments of floating spring 22 described herein can be used not only in the single-pole, single-throw switch described, but also in double-pole, three-way and four-way switches.

Figure 16:
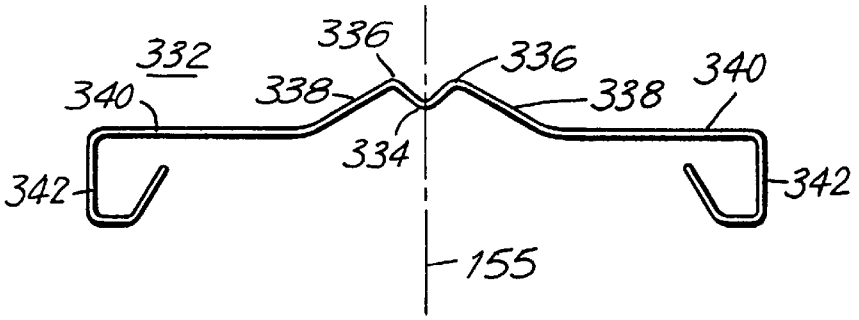

FIG. 16 shows another rocker cam spring 332 which is symmetrical about a center plane 155 where the spring has a small center well 334 rising to a pair of apices 336, one on each side of the center plane 155. The outward side of each apex 336 is formed by a downward ramp 338 which joins a horizontal support portion 340 that terminates in a folded under end portion 342. The sides of the well 334 are relatively sharply angled, preferably at about 90° to each other, while the ramps 338 are spread out, at approximately 120° to each other. The spring 332 is a leaf spring of unitary construction made from, preferably, stainless steel strip.

This small-well configuration cam spring 332 is also effective in controlling rocker movements in maintained-contact switches of several styles including single-pole, double-throw, and double-pole double-throw switches. The small center well 334 can hold the rocker cam 96 in a center position where the rocker cover 10 is symmetrically disposed with each contact surface 36 raised about 5 degrees above the rocker cover frame 14. Depressing either one moves the rocker cam 96 to the other side of the center plane 155, over an apex 336 which springs back to hold the rocker cam 96 in place until the other contact surface 36 is pressed. The switch thus has a center open position and two closed positions, one to the left and one to the right. Appropriate electrical contacts can be made by one or more movable brush arms centered in an open position between a pair of contacts. Rocker and slider movement pushes the brush to make contact either to the left or the right.

In a modified embodiment which is a double-pole switch rather than the single-pole switch described, the switch base 16 is adapted to provide a second fixed terminal assembly having a second fixed button contact facing the first button contact 256 of the first fixed terminal assembly 24, but spaced therefrom. For this purpose the switch base 16 is provided with a second terminal opening in its skin 162 which opening is defined between a further pair of grooved rails 230 and 232 to hold the second contact assembly. The movable brush arm 266 is adapted to have a second movable button contact behind the first contact 268 and to be biased to a central, open position between the two fixed contacts. The slider 20 is arranged or modified so that the first rib 105 and the first brush pusher 106 embrace the modified movable brush arm with the pusher oriented to extend towards the contacts on the brush arm so that the slider 20 can push the brush arm into contact from either side, with the rib 105 or the pusher 106, according to which end of the rocker cover is depressed.

A four-pole switch can be provided by incorporating two such modified brush and terminal assemblies in opposed disposition across the switch base. A modified slider 20 can operate the two brush arms in tandem. Other customary switch arrangements, such as a three-pole switch using a single-contact brush and a double-contact brush, with corresponding terminal assemblies, will be apparent to those skilled in the art.

Figure 17:
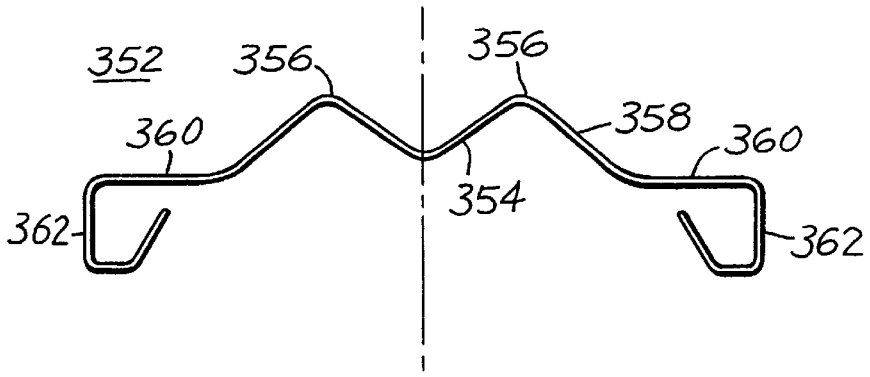

The spring shown in FIG. 17, rocker cam spring 352, is suitable for a momentary switch and is symmetrical about the center plane 155 where the spring has a relatively large center well 354 rising to a pair of rounded apices 356, one on each side of the center plane 155. The outward side of each apex 356 is formed by a downward ramp 358 which joins a horizontal support portion 360 that terminates in a folded under end portion 362. The sides of the well 354 are relatively open, preferably at about 110 degrees to each other, while the ramps 358 are steeper at approximately 100 degrees to each other. The spring 352 is also a leaf spring of unitary construction from, preferably, stainless steel strip.

In this embodiment, the well 354 is big enough that the rocker cam 96 can never escape it. Manual pressure on one of the contact surfaces 36 causes the rocker cam to deform the spring 352 to the left or the right and to make contact only so long as the pressure is maintained. As soon as the manual pressure is released, the spring 352 regains its shape, centering the rocker cam 96 and the rocker assembly. This spring 352 is suitable for a double-throw momentary switch which can be either single-pole or double-pole.

The springs 332 and 352 are interchangeable, enabling an installer to select the switch characteristics by inserting an appropriate spring in the spring chamber 210 after disassembling the switch. Alternatively, the spring box 216 can be a separately molded, removable part secured, for example, with screws.

An especially meritorious feature of the invention lies in the control over the brush movement provided by the brush actuator means constituted by the slider 20 and its ribs and pushers. The outer edge of a pusher 106 or 112 can in fact be virtually directly adjacent to the movable button contact 268 and with appropriate design of the slider assembly 20 can be the engaging edge that contacts the movable brush arm 266 during contact opening and closing, enabling precise control over those movements to be achieved. The result can be less serious arcing and smaller contact gaps: a precision switch.

In commercial environments, even more than domestic environments, a switch is liable to be subjected to abuse, being operated by objects such as canes, books or elbows and may very well be hit quite hard with the side of a fist. The switches of this invention are well adapted to tolerate such treatment without suffering appreciable damage. For this purpose various load-transmitting structures have been provided. A primary load-transmitting means may be seen in the way the mounting strap 18 closely cradles the switch assembly on three sides so that downward (in the sense of FIG. 1A, but horizontal when wall-mounted) loads on the switch are spread across the length and breadth of the back flat surfaces 280 of the mounting strap 18 and transmitted by tension in the side flat surfaces 278, in a very satisfactory and solid manner, to the wall itself (assuming the switch to be wall-mounted) by the end flanges 282. This effect is assisted by providing the rectangular opening 306 to pass the relatively fragile spring box 216 through the back flat surfaces 280 relieving the spring box 216 of any such loading. This feature also reduces the overall depth of the switch rendering it more compact and leaving plenty of room for packing excess wiring in the wall box.

The stops 128 and the bearing seats 148 cooperate to transmit loads from a depressed side of the rocker cover while square engagement of the rocker cover frame 14 against the upper, flat surface of the switch base 16 and the solid nature of the switch base with reinforcements, the screw pillars 204 and various other structures that have been mentioned, provide a surprisingly robust construction to transmit loads to the mounting strap 18. Even using molded thermoplastic material throughout, except for necessarily conductive components, a switch can be constructed according to the invention to be capable of taking substantial hammer blows without detectable damage.

Electrically, the design is not dependent upon any intricate or delicate conductive parts, but rather is carefully developed so that the switch can be built with rather simple conductive components that, as described, can be quite solid and substantial and made of the best electrical materials to carry relatively high currents in a safe manner. Compliance with demanding current and future building codes and electrical safety standards is assured by carefully isolating the various terminal assemblies and other conductors by means of insulating walls or structures and by maximal spacing between conductors, all of which is assisted by a design which permits the use of thermoplastic material throughout. A minimum of conductor surface is exposed at the back of the switch.

The embodiments of the invention disclosed and described in the present specification, drawings and claims are presented merely as examples of the invention. Other embodiments, forms and modifications thereof will suggest themselves from a reading thereof and are contemplated as coming within the scope of the present invention.

What is claimed is:

1. An electrical rocker switch comprising:

a) a switch housing;

b) a manually movable rocker cover mounted on said housing;

c) actuator means having a first end and a second end, said actuator means attached to said rocker cover at said first end and movable in response to the movement of said rocker cover;

d) slider means comprised wholly of insulating material coupled to and adjacent said second end of said actuator means and responsive to movement of said actuator means to move in one of two opposite directions along a common linear axis;

e) a fixed terminal assembly mounted in said housing and having a fixed contact thereon;

f) a movable brush assembly mounted in said housing comprising a resilient brush arm fixed to said housing at a first end and having a movable contact on said resilient brush arm at a second end, said resilient brush arm being biased to bring said movable contact on said resilient brush arm into mating position with said fixed contact of said fixed assembly to thereby electrically close said switch and said resilient brush arm being movable by said slider means to disengage said movable contact on said resilient brush arm from said fixed contact of said fixed terminal assembly to thereby open said switch;

e) a cam spring positioned adjacent to said second end of said actuator means, said second end of said actuator means engaging said cam spring to aid in the control of the movement of said actuator means;

f) a rocker cover frame in which said rocker cover is mounted and which is matable with said switch housing;

g) said rocker cover frame has at each end thereof a pair of inwardly facing load bearing stops against the tops of which said rocker cover can abut when said rocker is pressed; and h) resilient pads adjacent said load bearing stops to cushion said rocker cover at the ends of its travel as it is manually moved between its two set positions.

2. An electrical rocker switch as set forth in claim 1, wherein said resilient brush arm is biased by the manner it is shaped.

3. An electrical rocker switch as set forth in claim 1, wherein said housing further comprises:

a) switch base having separate chambers therein for individually housing said slider means, said cam spring, said fixed terminal assembly, and said movable brush assembly in a separate chamber.

* * * * *